US008997980B2

(12) United States Patent
Ghini et al.

(10) Patent No.: US 8,997,980 B2
(45) Date of Patent: Apr. 7, 2015

(54) SLIDE-OPEN PACKAGE OF TOBACCO ARTICLES WITH A COUPON, AND PACKING METHOD AND MACHINE FOR PRODUCING THE SAME

(75) Inventors: Marco Ghini, Monte San Pietro (IT); Andrea Biondi, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 46 days.

(21) Appl. No.: 13/881,342

(22) PCT Filed: Oct. 27, 2011

(86) PCT No.: PCT/IB2011/002656

§ 371 (c)(1),
(2), (4) Date: Jun. 25, 2013

(87) PCT Pub. No.: WO2012/056314

PCT Pub. Date: May 3, 2012

(65) Prior Publication Data

US 2013/0270130 A1 Oct. 17, 2013

(30) Foreign Application Priority Data

Oct. 27, 2010 (IT) ..... BO2010A0643
Jan. 19, 2011 (IT) ..... BO2011A0011

(51) Int. Cl.
*B65D 85/10* (2006.01)
*B65D 85/00* (2006.01)
*B65B 19/22* (2006.01)
(Continued)

(52) U.S. Cl.
CPC ..... *B65D 85/00* (2013.01); *B65B 19/226* (2013.01); *B65B 61/20* (2013.01); *B65D 5/721* (2013.01); *B65D 5/728* (2013.01);
(Continued)

(58) Field of Classification Search
USPC ..... 206/271, 273, 265, 267, 270, 831
See application file for complete search history.

(56) References Cited

U.S. PATENT DOCUMENTS 1,967,204 A * 7/1934 Genz ..... 206/264
3,363,821 A * 1/1968 Melconian ..... 206/267
(Continued)

FOREIGN PATENT DOCUMENTS

EP 0 709 306 A1 5/1996
FR 2 499 947 A3 8/1982
(Continued)

OTHER PUBLICATIONS

International Search Report in international application No. PCT/IB2011/002656, dated May 7, 2012.

*Primary Examiner* — Jacob K Ackun
(74) *Attorney, Agent, or Firm* — Marshall, Gerstein & Borun LLP

(57) ABSTRACT

A slide-open package of tobacco articles, having a parallelepiped-shaped inner container housing a group of tobacco articles and having a bottom wall, an extraction opening opposite the bottom wall, two parallel opposite major lateral walls, and two parallel minor lateral walls interposed between the major lateral walls; a parallelepiped-shaped outer container, which houses the inner container to allow the inner container to slide between a closed position, in which the inner container is inserted inside the outer container, and an open position, in which the inner container is at least partly extracted from the outer container; and a coupon folded about the group of tobacco articles and located between the group of tobacco articles and the inner container.

2 Claims, 14 Drawing Sheets

(51) Int. Cl.

| | |
|---|---|
| ***B65B 61/20*** | (2006.01) |
| ***B65D 5/72*** | (2006.01) |
| ***B65D 5/54*** | (2006.01) |

(52) U.S. Cl.

CPC ..... *B65D 85/1036* (2013.01); *B65D 85/1081* (2013.01); *B65D 5/5445* (2013.01); *Y10S 206/831* (2013.01)

(56) References Cited

U.S. PATENT DOCUMENTS

| | | | | |
|---|---|---|---|---|
| 4,534,463 | A | 8/1985 | Bouchard | |
| 4,559,758 | A | 12/1985 | Gamberini | |
| 5,080,227 | A | 1/1992 | Focke | |
| 5,715,936 | A * | 2/1998 | Focke et al. | 206/268 |
| 6,742,652 | B1 * | 6/2004 | Focke et al. | 206/268 |
| 7,392,899 | B2 * | 7/2008 | Pham | 206/264 |
| 2003/0089628 | A1 * | 5/2003 | Focke et al. | 206/268 |
| 2007/0251841 | A1 * | 11/2007 | Fath et al. | 206/273 |
| 2008/0164161 | A1 * | 7/2008 | Tosaka et al. | 206/268 |
| 2009/0188817 | A1 * | 7/2009 | Margolis | 206/237 |
| 2010/0224514 | A1 | 9/2010 | Urf et al. | |

FOREIGN PATENT DOCUMENTS

| | | | |
|---|---|---|---|
| GB | 2 466 204 | A | 6/2010 |
| IT | 1169163 | B | 5/1987 |
| WO | WO-2006/021581 | A1 | 3/2006 |
| WO | WO-2009/043072 | A1 | 4/2009 |
| WO | WO-2009/101120 | A1 | 8/2009 |
| WO | WO-2011/054419 | A1 | 5/2011 |

* cited by examiner

SLIDE-OPEN PACKAGE OF TOBACCO ARTICLES WITH A COUPON, AND PACKING METHOD AND MACHINE FOR PRODUCING THE SAME

CROSS-REFERENCE TO RELATED APPLICATIONS

This is the U.S. national phase of International Application No. PCT/IB2011/002656, filed Oct. 27, 2011, which claims the benefit of Italian patent Application No. BO2010A000643, filed Oct. 27, 2010, and Italian patent Application No. BO2011A000011, filed Jan. 19, 2011.

TECHNICAL FIELD

The present invention relates to a slide-open package of tobacco articles with a coupon, and a packing method and machine for producing a slide-open package of tobacco articles with a coupon.

In the following description, reference is made, for the sake of simplicity and purely by way of a non-limiting example, to a slide-open packet of cigarettes.

BACKGROUND ART

Rigid, hinged-lid packets of cigarettes are currently the most widely marketed, by being easy to produce, easy and practical to use, and by effectively protecting the cigarettes inside.

In addition, rigid, slide-open packets of cigarettes have been proposed, comprising two containers, one inserted inside and partly extractable from the other. More specifically, a rigid, slide-open packet of cigarettes comprises an inner container containing a foil-wrapped group of cigarettes, and which is housed inside an outer container to slide, with respect to the outer container, between a closed position, in which the inner container is inserted inside the outer container, and an open position, in which the inner container is extracted from the outer container. The inner container may either slide straight out of the outer container or swing out about a hinge connecting the two containers.

A number of embodiments of rigid, straight slide-open packets of cigarettes are described in GB2466204A, FR2499947A1, U.S. Pat. Nos. 4,534,463A1, 5,080,227A1 and IT1169163B; and one embodiment of a rigid, swing-open packet of cigarettes is described in WO2006021581A1.

Some packets of cigarettes contain coupons comprising either a single or folded sheet printed with advertising matter or pictures.

In a rigid, slide-open packet, the coupon is normally inserted between the outer container and a transparent plastic overwrap. This embodiment has the advantage of the coupon being removable immediately, when the packet is unsealed, but also the disadvantage of the coupon being visible on the sealed packet (whereas, in some cases, it is preferable that the coupon only be visible when the packet is opened). More importantly, the position of the coupon with respect to the packet is unstable, thus spoiling the look of the finished packet. That is, until the transparent overwrap is applied about the packet of cigarettes and the coupon to hold the coupon in place, the coupon tends to slip randomly from the position into which it is fed onto the packet, as the packet travels along the packing line.

One proposed solution to the problem is to supply the coupon together with the transparent overwrap, but this poses serious construction design problems by having to supply two different materials together and in a precise position with respect to each other.

Another proposed solution is to glue the coupon to the packet, but this has the drawback of having to subsequently tear a portion of the coupon off the packet, thus spoiling the look of the coupon and/or packet itself.

Patent application WO2009/101120A1 discloses a cigarette packing machine for producing a rigid packet with a hinged lid; the packing machine has a first packing unit which folds a first blank about a group of cigarettes to form an outer container with a hinged lid; and a second packing unit which folds a second blank about the outer container to form a tubular slide surrounding the outer container to slide axially with respect to the outer container.

DESCRIPTION OF THE INVENTION

It is an object of the present invention to provide a slide-open package of tobacco articles with a coupon, and a packing method and machine for producing a slide-open package of tobacco articles with a coupon, designed to eliminate the above drawbacks, and which, in particular, are cheap and easy to implement.

According to the present invention, there are provided a slide-open package of tobacco articles with a coupon, and a packing method and machine for producing a slide-open package of tobacco articles with a coupon, as claimed in the accompanying Claims.

PREFERRED EMBODIMENTS OF THE INVENTION

Figure 1:
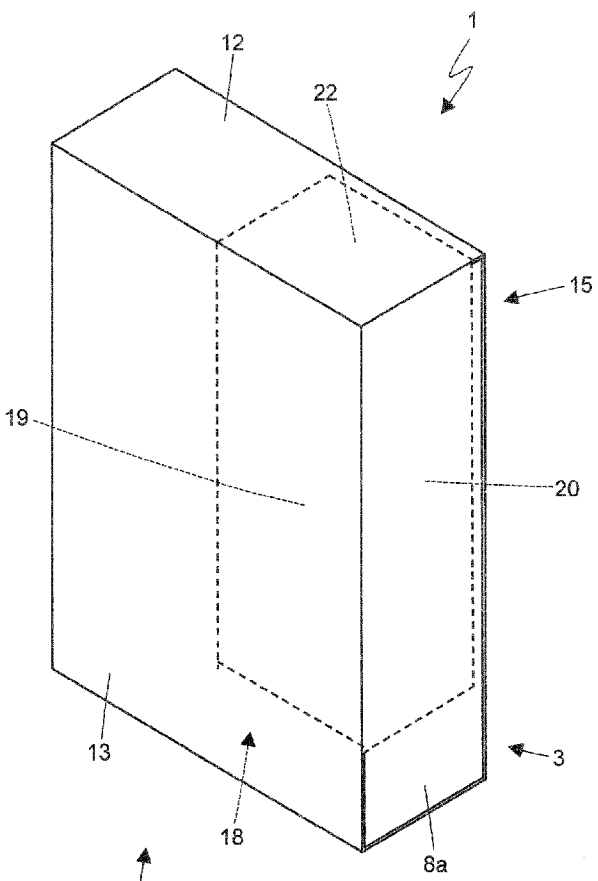
FIG. 1 shows a front view in perspective of a rigid, straight slide-open packet of cigarettes in accordance with the present invention and in a closed position.

Number 1 in FIG. 1 indicates as a whole a rigid, straight slide-open packet of cigarettes.

Figure 2:
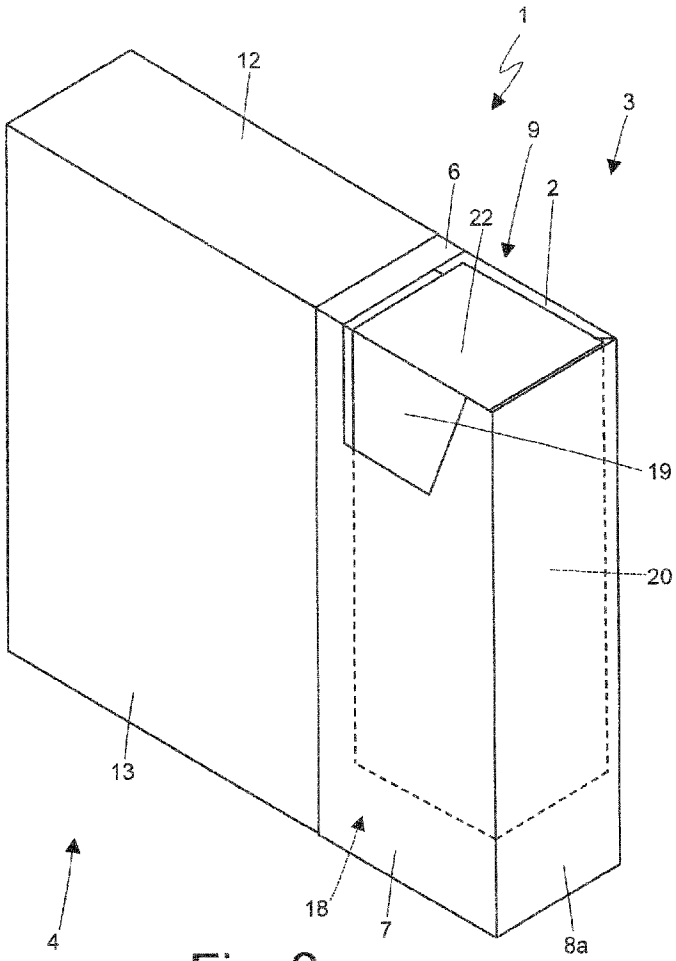
FIG. 2 shows a front view in perspective of the FIG. 1 packet of cigarettes in an open position.
Figure 3:
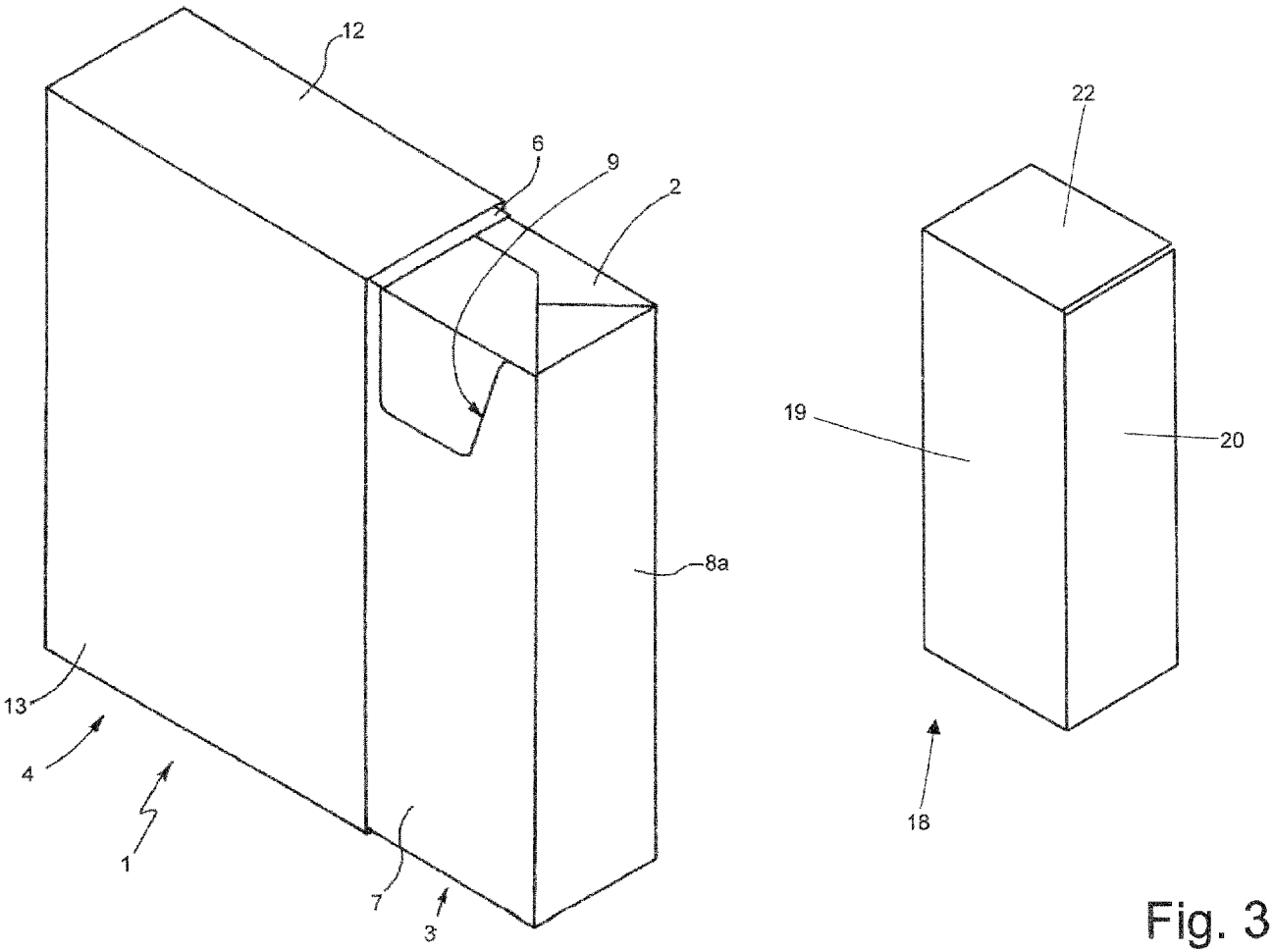
FIG. 3 shows a front view in perspective of the FIG. 1 packet of cigarettes in the open position and with a coupon removed.

The FIG. 1 packet 1 of cigarettes comprises a wrapped, i.e. foil-wrapped, group 2 of cigarettes (not shown); and a rigid outer package made of cardboard or similar, housing the wrapped group 2, and in turn comprising a rigid inner container 3 actually housing the wrapped group 2, and a rigid outer container 4, in which inner container 3 is housed to slide straight, with respect to outer container 4, between a closed position (FIG. 1), in which inner container 3 is fully inserted inside outer container 4, and an open position (FIGS. 2 and 3), in which inner container 3 is partly expelled from outer container 4 for direct user access to wrapped group 2.

Figure 4:
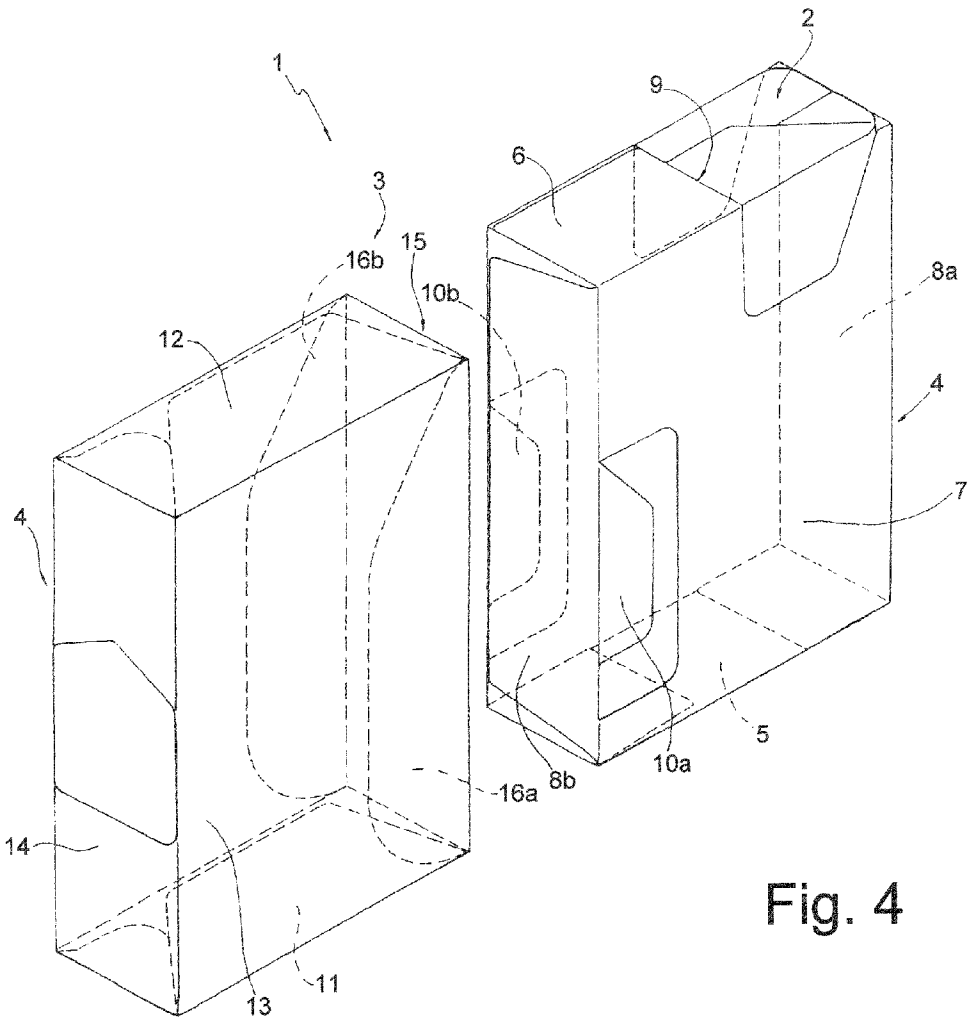
FIG. 4 shows an exploded view in perspective of the FIG. 1 packet of cigarettes without the coupon.
Figure 6:
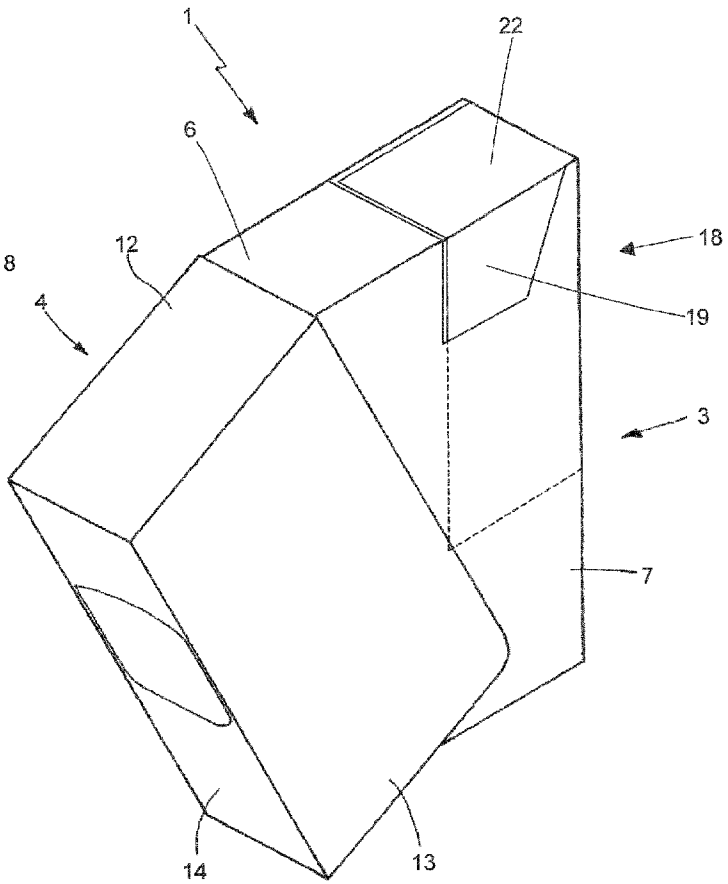
FIG. 6 shows a front view in perspective of the FIG. 5 packet of cigarettes in an open position.
Figure 5:
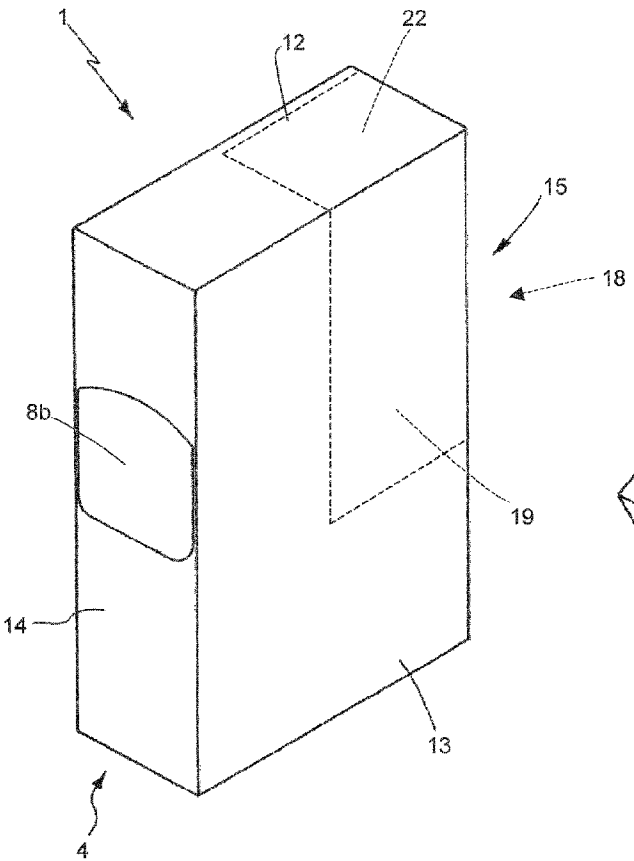
FIG. 5 shows a front view in perspective of a rigid, swing-open packet of cigarettes in accordance with the present invention and in a closed position.
Figure 8:
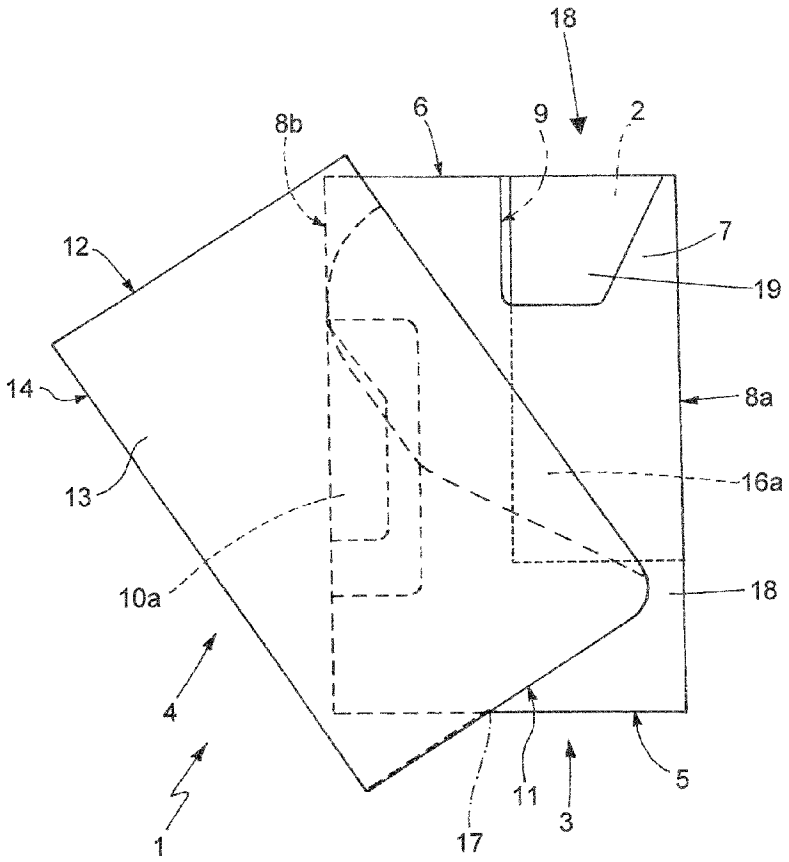
FIGS. 7 and 8 show two side views of the FIG. 5 packet of cigarettes in the closed and open position respectively, and with a number of internal component parts of the packet indicated by dash lines.
Figure 7:
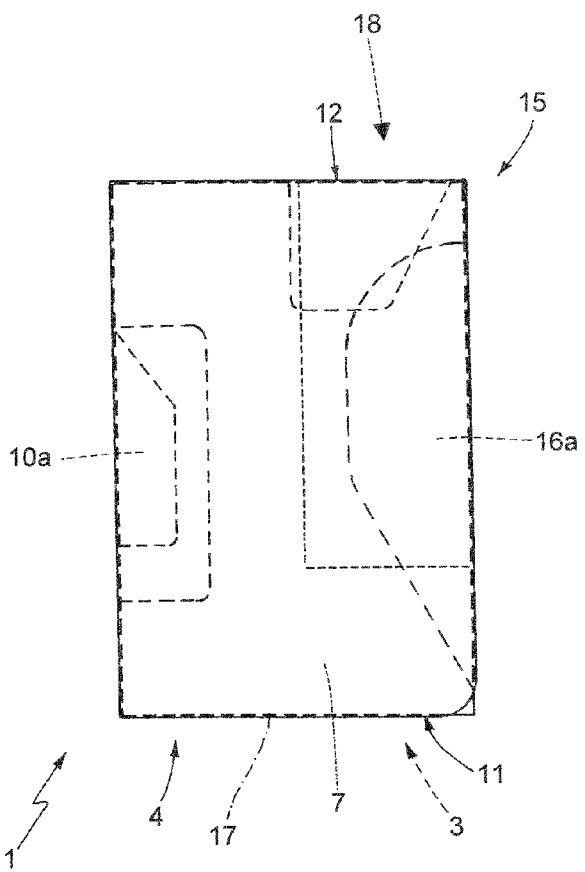

As shown in FIG. 4 inner container 3 is parallelepiped-shaped, and comprises a bottom wall 5; a top wall 6; two opposite parallel major lateral walls 7; and two parallel minor lateral walls 8*a*, 8*b* interposed between major lateral walls 7. Close to minor lateral wall 8*a*, top wall 6 has a withdrawal opening 9, which also extends over part of major lateral walls 7, and which, when inner container 3 is in the open position, is located outside outer container 4 to enable withdrawal of the cigarettes (not shown) from inner container 3, once group 2 is unwrapped by the user. Close to minor lateral wall 8*b*, a retaining tab 10 is cut from each major lateral wall 7, and projects outwards of inner container 3 from the edge between major lateral wall 7 and minor lateral wall 8*b*. Four longitudinal edges are defined between major lateral walls 7 and minor lateral walls 8, and eight transverse edges are defined between lateral walls 7, 8 and walls 5, 6.

In a different embodiment not shown, top wall 6 of inner container 3 is replaced entirely by extraction opening 9, which is therefore the same size as bottom wall 5; and at least one of lateral walls 7 or 8 may be shorter than as shown in FIGS. 1-8.

As shown in FIG. 4, outer container 4 is also parallelepiped-shaped, and comprises a bottom wall 11; a top wall 12; two opposite parallel major lateral walls 13; a minor lateral wall 14; and an opening 15 opposite minor lateral wall 14 and through which inner container 3 is fitted in sliding manner. A retaining tab 16 is connected to each major lateral wall 13, along the edge of major lateral wall 13 defining opening 15, projects inwards of outer container 4 from major lateral wall 13, and, as inner container 3 is expelled, engages a corresponding retaining tab 10 of inner container 3 to act as a limit stop and prevent detachment of inner container 3 from outer container 4. Two longitudinal edges are defined between major lateral walls 13 and minor lateral wall 14, and six transverse edges are defined between lateral walls 13, 14 and walls 11, 12.

Minor lateral wall 14 of outer container 4 has a central hole shaped and sized to allow the user to exert pressure, through minor lateral wall 14, on minor lateral wall 8*b* of inner container 3 to slide inner container 3 into the open position.

In the FIG. 1-4 embodiment, packet 1 of cigarettes slides straight open, i.e. inner container 3 slides with respect to outer container 4 and between the open and closed positions in a translatory movement (i.e. a straight movement in a direction parallel to the major transverse edges); whereas, in the FIG. 5-8 embodiment, packet 1 of cigarettes swings open, i.e. inner container 3 slides with respect to outer container 4 and between the open and closed positions in a rotary movement about a hinge 17 connecting bottom wall 5 of inner container 3 to bottom wall 11 of outer container 4. In other words, the difference between the FIGS. 1-4 and FIGS. 5-8 packets 1 of cigarettes lies in the inner container 3 of the FIGS. 5-8 packet 1 of cigarettes being hinged (i.e. connected) to outer container 4 at hinge 17, whereas, in the FIG. 1-4 packet 1 of cigarettes, inner container 3 is simply inserted inside outer container 4, with no connection of any sort between containers 3 and 4. As a result, containers 3 and 4 of the FIG. 5-8 packet 1 of cigarettes swing with respect to each other about hinge 17, whereas containers 3 and 4 of the FIG. 1-4 packet 1 of cigarettes slide straight with respect to each other.

Figure 9:
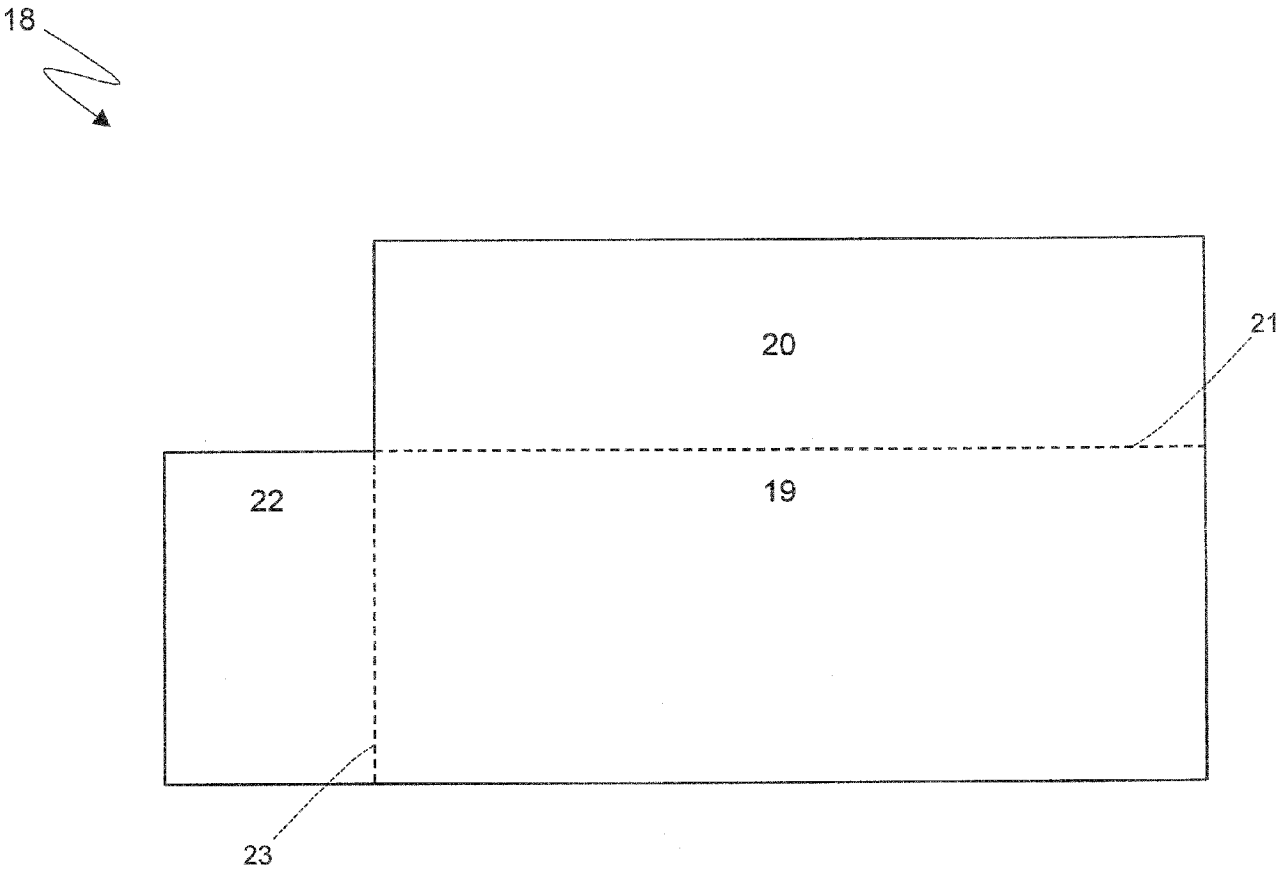
FIG. 9 shows a spread-out plan view of a coupon of the FIG. 1 packet of cigarettes.

Each packet 1 of cigarettes in FIGS. 1-8 comprises a coupon 18, which is almost rectangular when flat (as shown in FIG. 9), and is printed with advertising matter or pictures. Coupon 18 is inserted between wrapped group 2 and inner container 3, is folded about wrapped group 2, and comprises a rectangular lateral wall 19 contacting a major lateral wall (obviously, the inner surface of major lateral wall 7) of inner container 3; a rectangular lateral wall 20 connected to lateral wall 19 along a fold line 21, and folded 90° with respect to lateral wall 19 to contact minor lateral wall 8*a* (obviously the inner surface of minor lateral wall 8*a*) of inner container 3; and a rectangular top wall 22, which is connected to lateral wall 19 along a fold line 23, is folded 90° with respect to lateral wall 19 so as to be positioned at extraction opening 9 of inner container 3, and is perpendicular to lateral wall 20.

In the embodiment shown in the drawings, top wall 22 of coupon 18 is slightly smaller than extraction opening 9 of inner container 3, to enable easy withdrawal of coupon 18 through extraction opening 9. Obviously, the larger extraction opening 9 is, the larger coupon 18 may be.

In a different embodiment not shown, coupon 18 has no lateral wall 20 (i.e. only comprises lateral wall 19 and top wall 22), or has no lateral wall 19 (i.e. only comprises lateral wall 20 and top wall 22, which, in this case, is connected to lateral wall 20 along a corresponding fold line).

In one embodiment, fold line 21 and/or fold line 23 are tear lines (i.e. can be torn by exerting a small amount of pull) to detach lateral wall 20 and/or top wall 22 easily from lateral wall 19.

In a different embodiment not shown, packet 1 of cigarettes comprises two coupons 18 on opposite sides of wrapped group 2. In another embodiment not shown, coupon 18 comprises a second lateral wall 19 on the opposite side to the first lateral wall 19, i.e. comprises two lateral walls 19 on opposite sides of wrapped group 2 and contacting the two major lateral walls 7 of inner container 3.

When inner container 3 is in the closed position (FIGS. 1, 5, 7), coupon 18 is located inside inner container 3 inserted fully inside outer container 4, and is therefore concealed from view; and, when inner container 3 slides (straight or swings)

with respect to outer container 4 from the closed position (FIGS. 1, 5, 7) to the open position (FIGS. 2, 3, 6, 8), coupon 18 is withdrawn from outer container 4 together with inner container 3.

Figure 10:
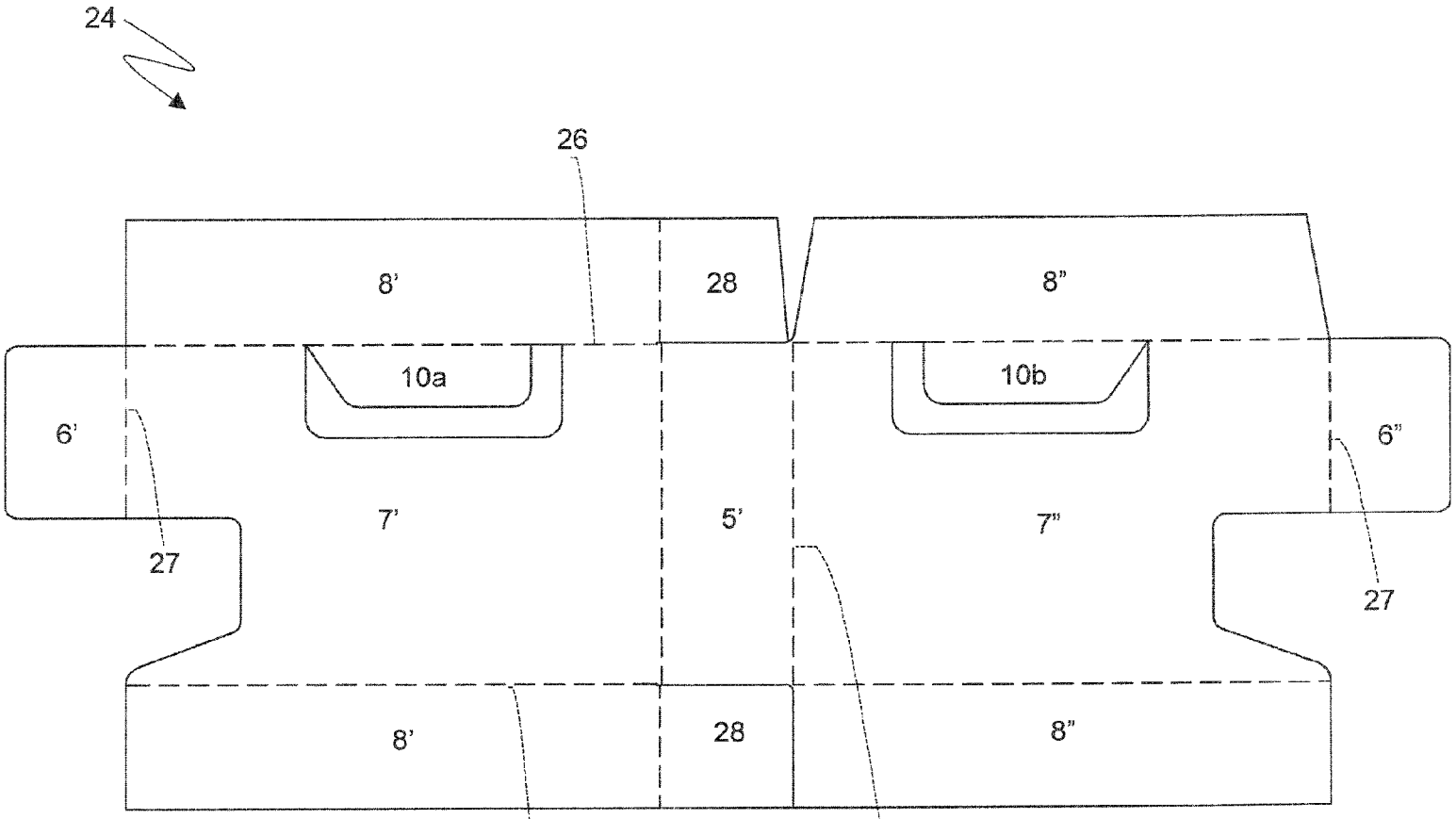
FIG. 10 shows a plan view of a blank from which to form an inner container of the FIG. 1 packet of cigarettes.
Figure 11:
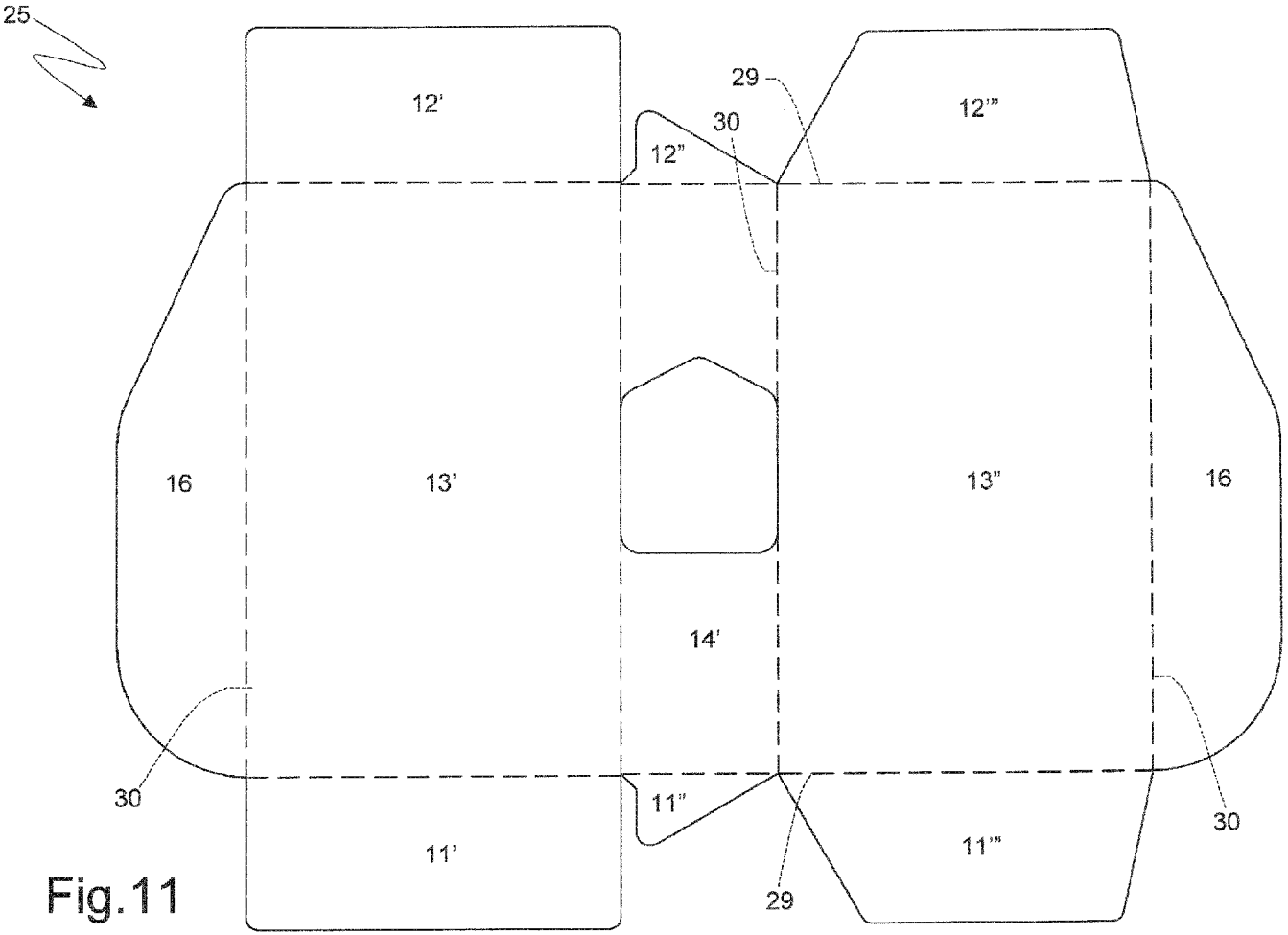
FIG. 11 shows a plan view of a blank from which to form an outer container of the FIG. 1 packet of cigarettes.

Containers 3 and 4 of the FIG. 1-4 packet 1 of cigarettes are formed from respective known blanks 24 and 25 shown in FIGS. 10 and 11 respectively. Among other things, blanks 24, 25 comprise a number of panels, which are indicated, where possible, using the same reference numbers, with superscripts, as for the corresponding parts of respective containers 3, 4.

With reference to FIG. 10, blank 24 has two longitudinal fold lines 26, and a number of transverse fold lines 27, which define, between longitudinal fold lines 26, a panel 6' forming part of top wall 6; a panel 7' forming one major lateral wall 7; a panel 5' forming bottom wall 5; a panel 7" forming the other major lateral wall 7; and a panel 6" forming the rest of top wall 6.

Panel 7' has two lateral wings 8', which form respective inner portions of minor lateral walls 8, are located on opposite sides of panel 7', and are separated from panel 7' by longitudinal fold lines 26. Panel 7" has two lateral wings 8", which form respective outer portions of minor lateral walls 8, are located on opposite sides of panel 7", and are separated from panel 7" by longitudinal fold lines 26. Lateral wings 8' of panel 7' each have a tab 28 separated from respective lateral wing 8' by a transverse fold line 27. And a window defining a respective retaining tab 10 is formed in each panel 7', 7".

With reference to FIG. 11, blank 25 has two transverse fold lines 29, and a number of longitudinal fold lines 30, which define, between transverse fold lines 29, a panel 13' forming one major lateral wall 13; a panel 14' forming minor lateral wall 14; and a panel 13" forming the other major lateral wall 13. Each panel 13', 13" has a retaining tab 16 located on the opposite side to panel 14', and separated from respective panel 13', 13" by a longitudinal fold line 30.

Panel 13' has two rectangular end wings 11' and 12', which are located at opposite ends of panel 13', are separated from panel 13' by transverse fold lines 29, and form respective outer portions of walls 11 and 12. Panel 14' has two end wings 11" and 12", which are located at opposite ends of panel 14', are separated from panel 14' by transverse fold lines 29, are triangular in shape with a rounded outer apex, and form respective inner portions of walls 11 and 12. Panel 13" has two trapezoidal end wings 12'" and 13'", which are located at opposite ends of panel 13", are separated from panel 13" by transverse fold lines 29, and form respective inner portions of walls 11 and 12. End wings 11" and 11'" and end wings 12" and 12'" are designed not to overlap when folded onto end wings 11' and 12' to define walls 11 and 12 of outer container 4.

Containers 3, 4 of the FIG. 5-8 packet 1 of cigarettes are formed from respective known blanks almost identical to blanks 24, 25 in FIGS. 10 and 11, used to form containers 3, 4 of the FIG. 1-4 packet 1 of cigarettes.

Figure 12:
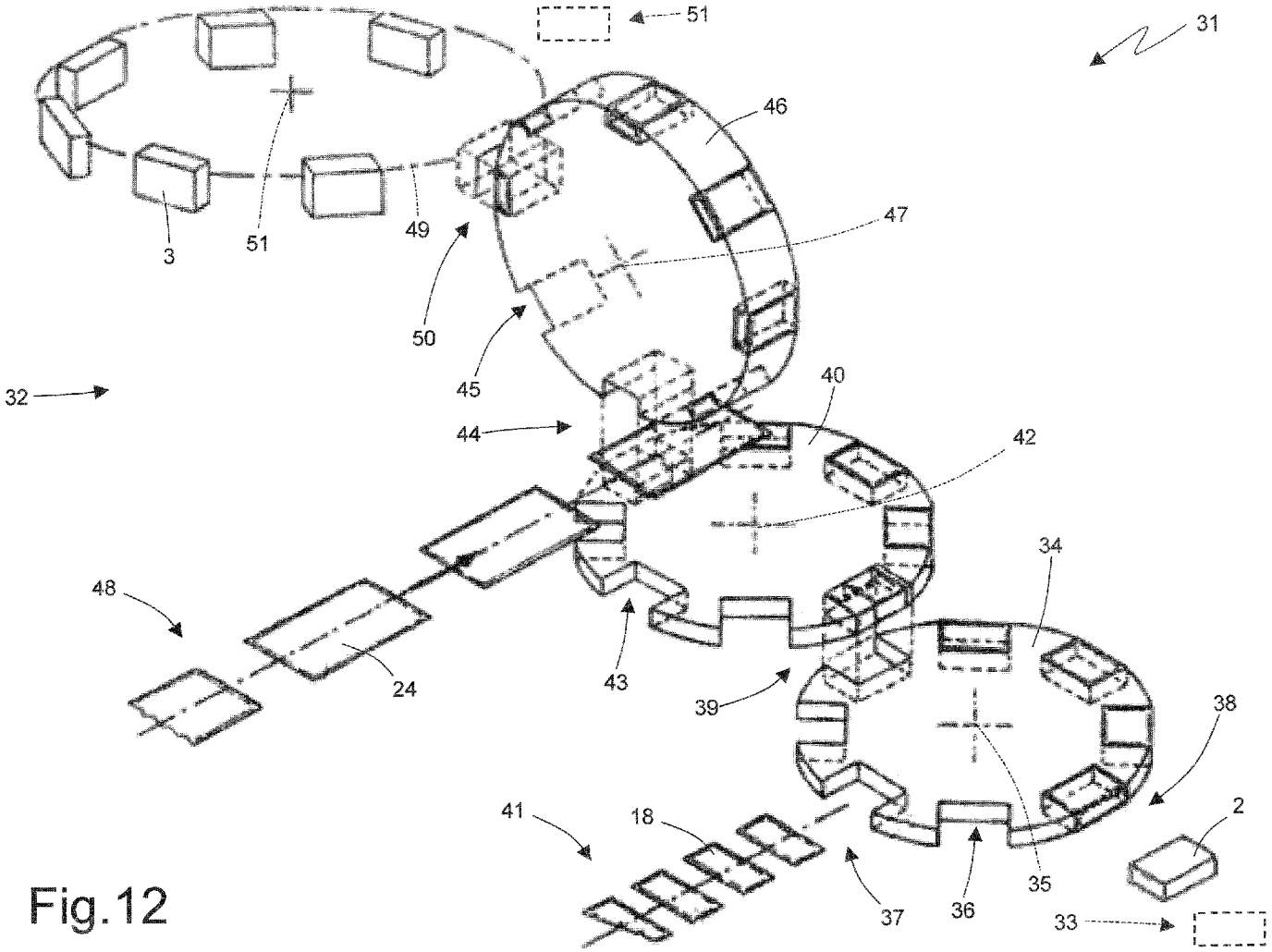
FIG. 12 shows a schematic view in perspective, with parts removed for clarity, of a packing unit of a packing machine for producing the FIG. 1 packet of cigarettes.

FIG. 12 shows part of a cigarette packing machine 31 for producing a packet 1 of cigarettes of the type described above and shown in FIGS. 1-4. More specifically, of packing machine 31, FIG. 12 shows a packing unit 32, which forms inner containers 3 of packets 1 of cigarettes by folding blanks 24 about wrapped groups 2 in substantially the same way as on packing machines X2, X3 or X6 produced by G.D. Società per Azioni.

Packing machine 31 also comprises a packing unit 33, which forms outer containers 4 (to complete packets 1 of cigarettes) by folding blanks 25 about inner containers 3 from packing unit 32.

Packing unit 32 of packing machine 31 comprises a first packing wheel 34, which rotates in steps about a vertical axis of rotation 35. First packing wheel 34 comprises a number of peripheral pockets 36, which, rotating in steps about axis of rotation 35, are fed successively through a coupon feed station 37, where each pocket 36 receives a flat coupon 18; a group transfer station 38, where a wrapped group 2 is inserted inside each pocket 36, and the previously supplied coupon 18 is folded about the wrapped group 2; and, finally, a transfer station 39, where each wrapped group 2, together with the folded coupon 18, is expelled from pocket 36 and transferred to a second packing wheel 40. Coupons 18 are fed to station 37 by a feed line 41.

Second packing wheel 40 rotates in steps about an axis of rotation 42 parallel to axis of rotation 35, is identical in design to first packing wheel 34, and has a number of peripheral pockets 43. In pockets 36 and 43 on first and second packing wheels 34 and 40, each rectangular parallelepiped-shaped wrapped group 2 is positioned flat, i.e. with a minor lateral surface facing outwards, and with its longitudinal axis (parallel to the cigarette axes) crosswise to axes of rotation 35, 42 and tangent to the periphery of relative packing wheel 34, 40. First and second packing wheels 34, 40 overlap at transfer station 39, and wrapped groups 2 are transferred from first packing wheel 34 to second packing wheel 40 in a vertical movement parallel to axes of rotation 35 and 42.

At a transfer station 44, each wrapped group 2 with a folded coupon 18 is transferred from a pocket 43 on second packing wheel 40 to a pocket 45 on a third packing wheel 46, which is mounted to rotate in steps about a horizontal axis of rotation 47, receives each wrapped group 2 and relative coupon 18 together with a rigid blank 24 supplied to transfer station 44 by a feed line 48, and folds each blank 24 about relative wrapped group 2 to form an inner container 3 housing the wrapped group 2 partly covered by coupon 18.

At a transfer station 50, inner containers 3 are fed successively from third packing wheel 46 to a fourth transfer wheel 49, which rotates in steps about a vertical axis of rotation 51 crosswise to axis of rotation 47 of third packing wheel 46, and, at transfer station 50, receives inner containers 3 successively from third packing wheel 46 and transfers them to packing unit 33.

Figure 13:
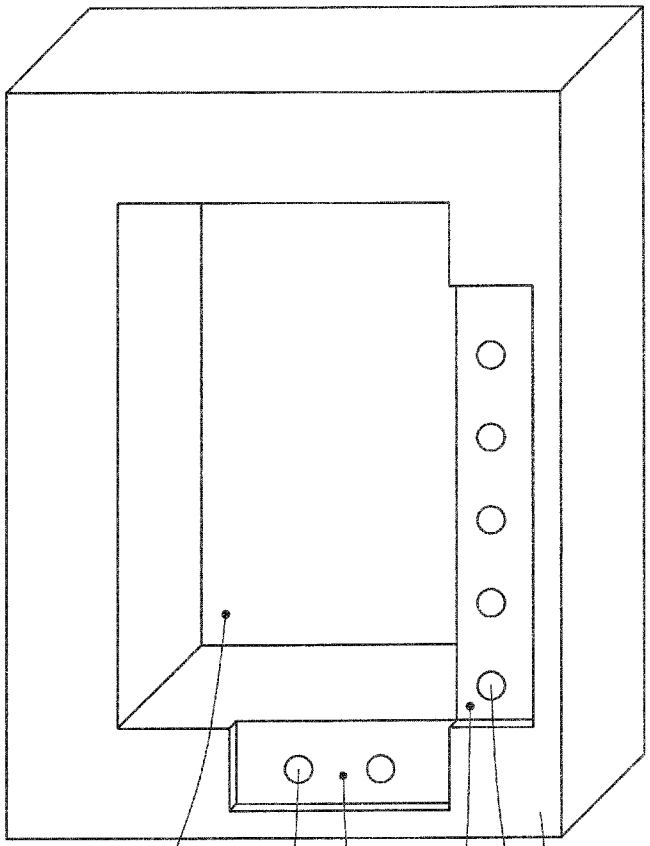

As shown in FIG. 13, each pocket 36 on first packing wheel 34 has a parallelepiped-shaped main seat 52, which negatively reproduces the shape of wrapped group 2 to house it, and which is designed to receive wrapped group 2 downwards at transfer station 38, and to release it upwards at transfer station 39. Main seat 52 of each pocket 36 is obviously fitted with supporting means (not shown) for supporting the wrapped group 2 from underneath, and ensuring the downward-inserted wrapped group 2 remains in the desired position inside main seat 52.

Figure 14:
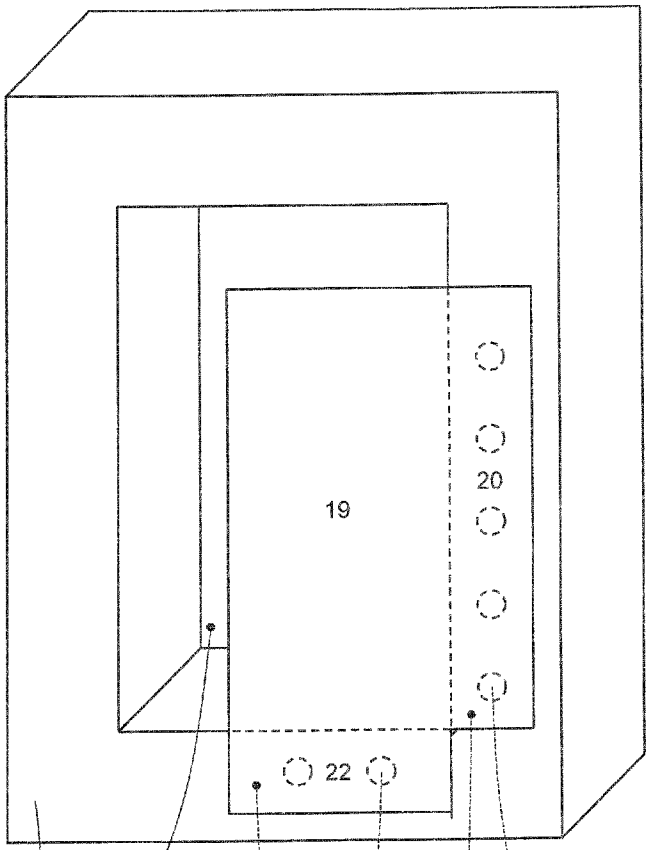
FIGS. 13 and 14 show two views of a pocket of a packing wheel of the FIG. 12 packing unit before and after receiving a coupon respectively.

Each pocket 36 on first packing wheel 34 also has a secondary seat 53 alongside main seat 52 and negatively reproducing the shape of walls 20 and 22 of coupon 18 to house a distended coupon 18. Secondary seat 53 is a suction seat, i.e. retains walls 20 and 22 of coupon 18 by suction, and, for this purpose, has a number of internal suction holes 54 connectable to a suction source. FIG. 14 shows a pocket 36 on first packing wheel 34 supporting a distended coupon 18. As can be seen, walls 20 and 22 of coupon 18 are inserted inside and retained by suction by secondary seat 53, whereas lateral wall 19 of coupon 18 extends, unsupported, over the top opening of main seat 52 (i.e. coupon 18 is only supported by walls 20 and 22 retained by suction by secondary seat 53, whereas lateral wall 19 'projects' over a void). Consequently, when inserted inside main seat 52, wrapped group 2 engages coupon 18 and simultaneously folds walls 20 and 22 of coupon 18 90° about fold lines 21 and 23. Obviously, as wrapped group 2 contacts lateral wall 19 of coupon 18, suction through holes 54 in secondary seat 53 of pocket 36 is cut off to allow walls 20 and 22 of coupon 18 to fold freely about fold lines 21 and 23.

Figure 17:
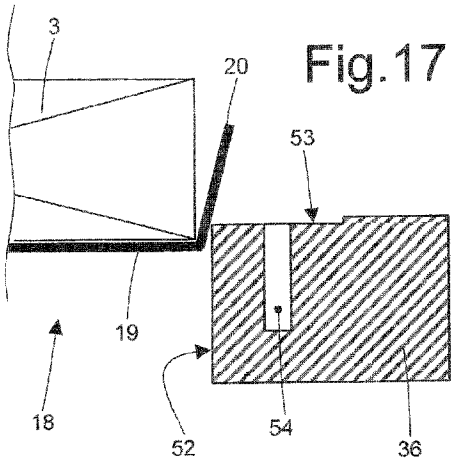
FIGS. 15-18 show four schematics of the FIGS. 13 and 14 pocket as it is fed with an inner container of the FIG. 1 packet of cigarettes.
Figure 18:
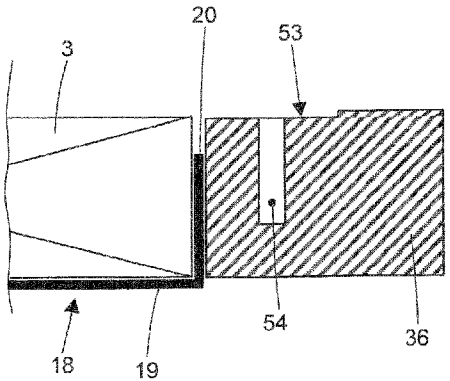
Figure 15:
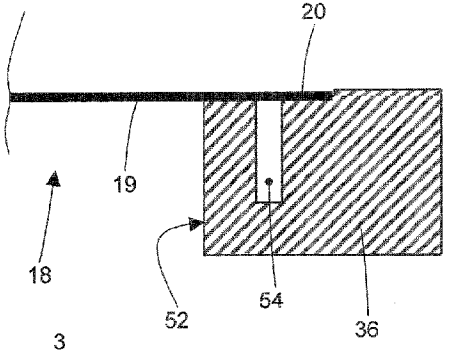
Figure 16:
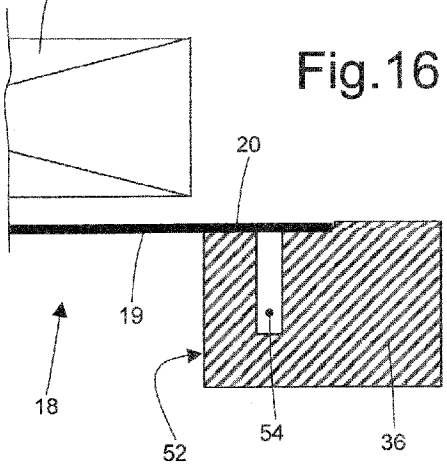

The way in which wrapped group 2 is inserted inside main seat 52 of pocket 36 on first packing wheel 34 is shown schematically in FIGS. 15-18. As shown in FIG. 15, a distended coupon 18 is first fed into secondary seat 53 of pocket 36 at feed station 37, so that walls 20 and 22 of coupon 18 are retained by suction by secondary seat 53 (as shown more clearly in FIG. 14). At transfer station 38, wrapped group 2 is first positioned over main seat 52 of pocket 36, as shown in FIG. 16, and is then inserted axially downwards into main seat 52 of pocket 36, as shown in FIG. 17, so as to push lateral wall 19 of coupon 18 downwards and fold walls 20 and 22 of coupon 18 90° about fold lines 21 and 23. FIG. 18 shows wrapped group 2 inserted completely inside main seat 52, with coupon 18 folded about wrapped group 2. At transfer station 39, wrapped group 2 and coupon 18 are extracted together from main seat 52 of pocket 36 on first packing wheel 34, and transferred together to a pocket 43 on second packing wheel 40.

Figure 19:
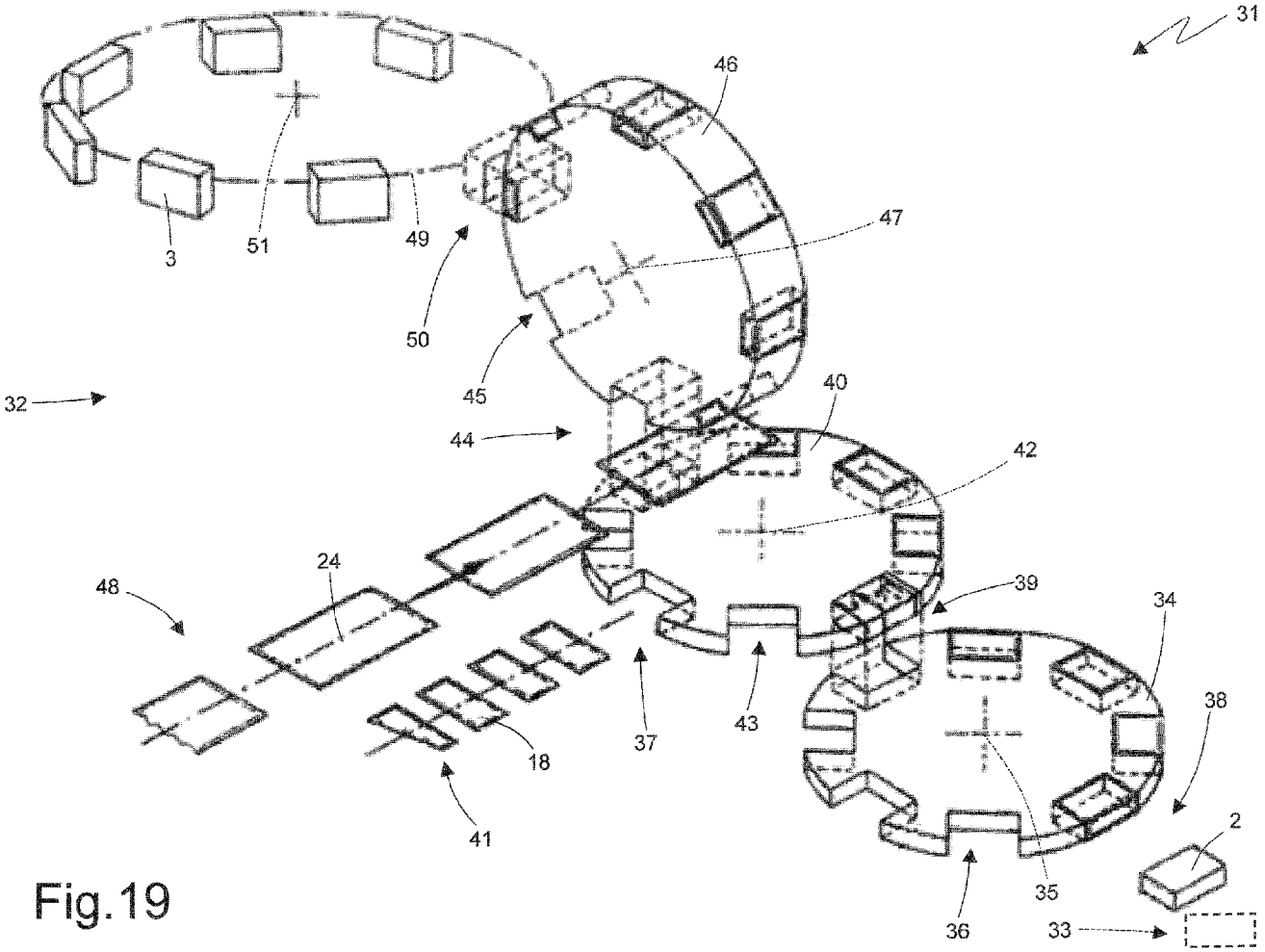
FIG. 19 shows a schematic view in perspective, with parts removed for clarity, of an alternative embodiment of the FIG. 12 packing unit.
Figure 21:
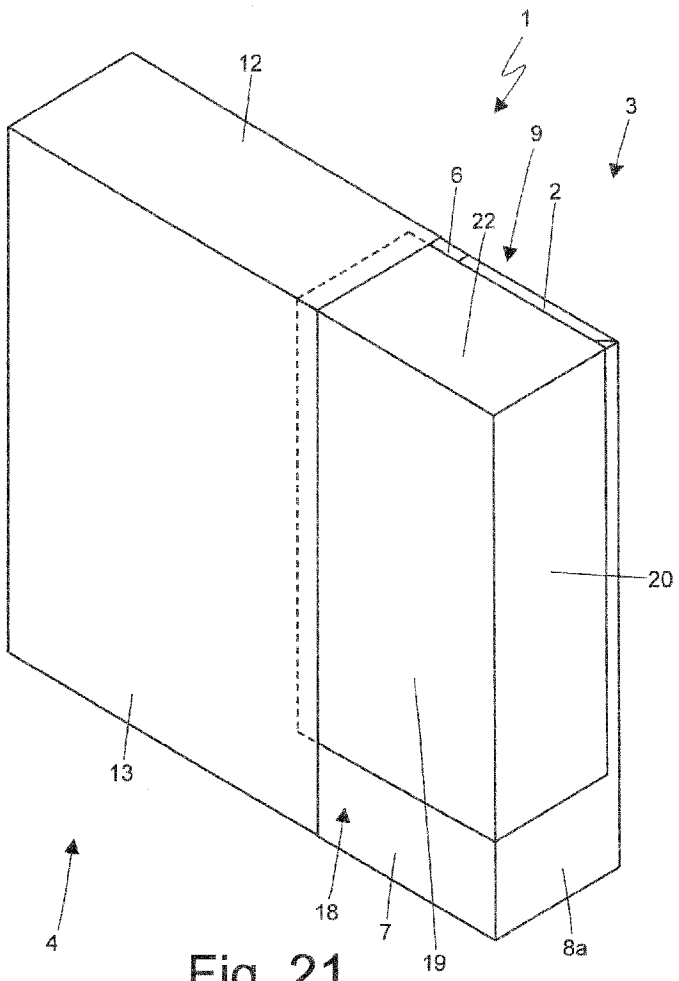
FIG. 21 shows a front view in perspective of the FIG. 21 packet of cigarettes in an open position.
Figure 20:
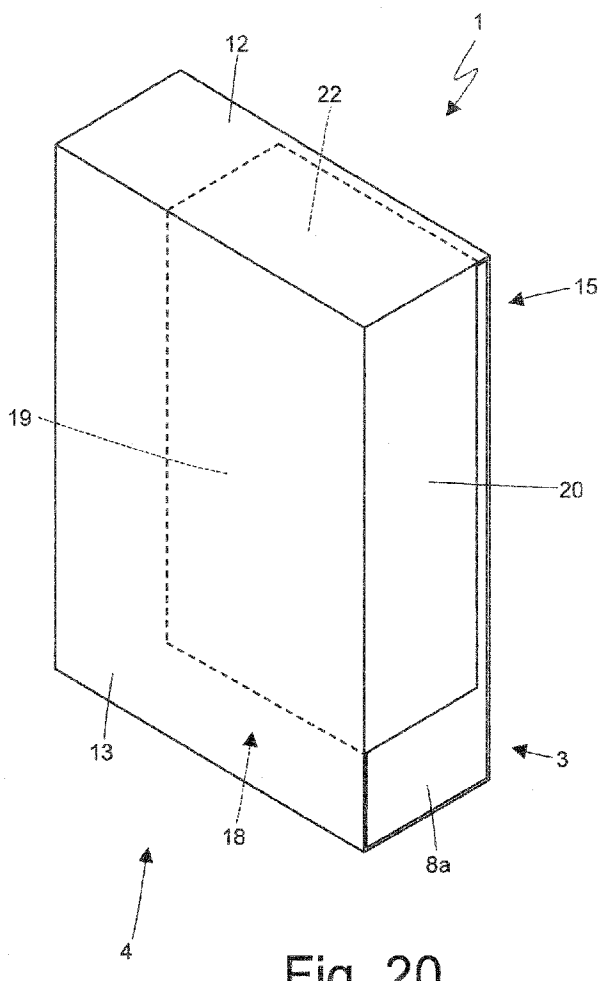
FIG. 20 shows a front view in perspective of an alternative embodiment of a rigid, straight slide-open packet of cigarettes in accordance with the present invention and in a closed position.
Figure 23:
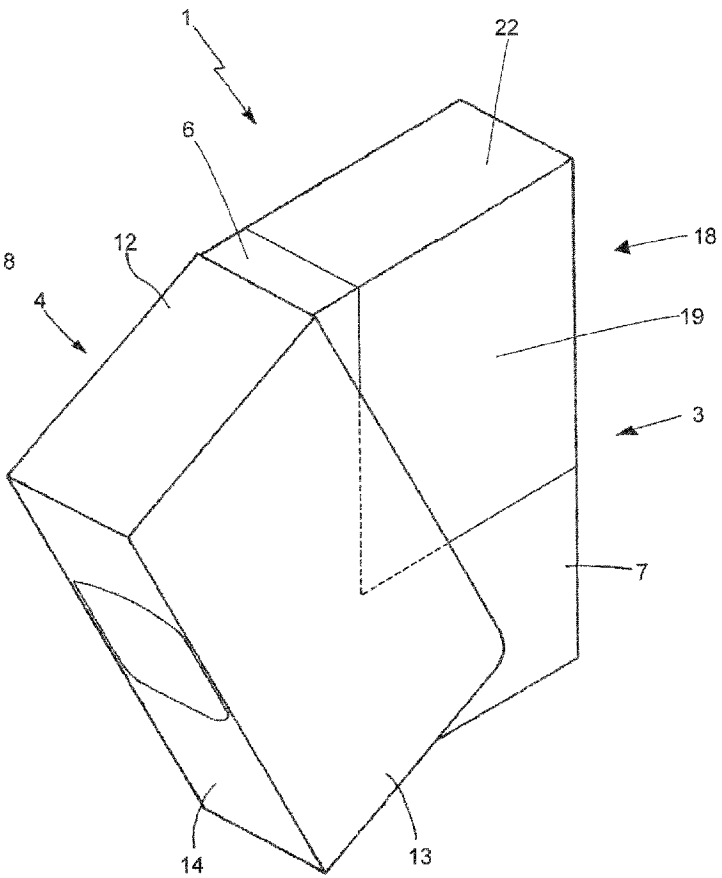
FIG. 23 shows a front view in perspective of the FIG. 22 packet of cigarettes in an open position.
Figure 22:
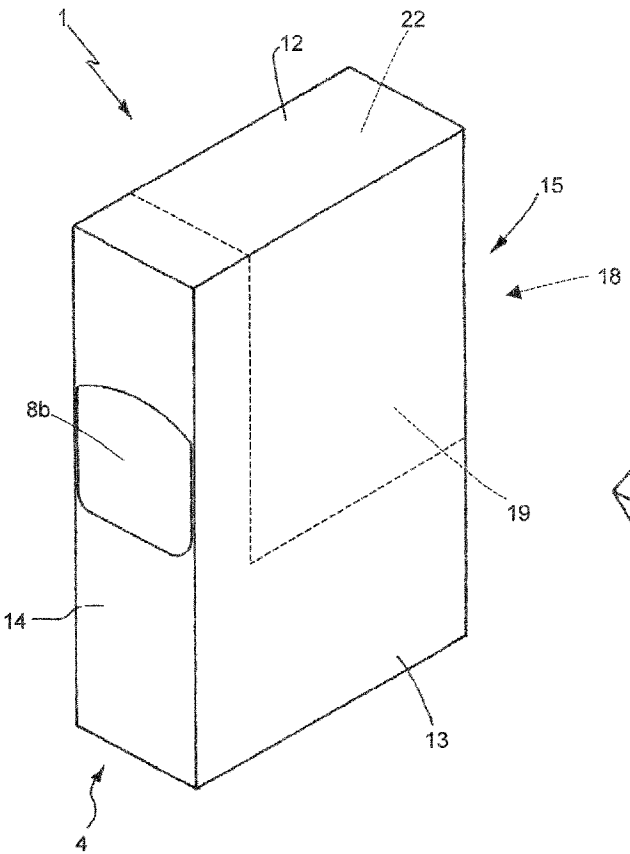
FIG. 22 shows a front view in perspective of an alternative embodiment of a rigid, swing-open packet of cigarettes in accordance with the present invention and in a closed position.

In packing unit 32 of packing machine 31 in FIG. 12, coupon feed station 37 is located at first packing wheel 34, so coupons 18 are fed, flat, to pockets 36 of first packing wheel 34, as described above. In packing unit 32 of packing machine 31 in FIG. 19, coupon feed station 37 is located at second packing wheel 40, so coupons 18 are fed, flat, to pockets 43 of second packing wheel 40, as opposed to pockets 36 of first packing wheel 34. In the FIG. 19 embodiment, pockets 43 of second packing wheel 40 are identical to pockets 36 of first packing wheel 34 described above, and so each comprise a main seat 52 for wrapped group 2, and a secondary seat 53 for a distended coupon 18. The way in which wrapped groups 2 and coupons 18 are fed into pockets 43 on second packing wheel 40 is also identical to that of pockets 36 on first packing wheel 34 described above. The FIG. 19 embodiment may have two variations. In a first (preferred) variation, each coupon 18 at feed station 37 is deposited on a bottom wall of a pocket 43 on second packing wheel 40 (i.e. secondary seat 53 is formed in the bottom wall of pocket 43), so coupon 18 is folded about wrapped group 2 at transfer station 39, when wrapped group 2 is inserted upwards into pocket 43 on second packing wheel 40. In the second variation, each coupon 18 at feed station 37 is deposited on a top wall of a pocket 43 on second packing wheel 40 (i.e. secondary seat 53 is formed in the top wall of pocket 43), so coupon 18 is folded about wrapped group 2 at transfer station 44, when wrapped group 2 is extracted upwards from pocket 43 on second packing wheel 40.

In the FIG. 1-8 embodiments, coupon 18 is located between wrapped group 2 and inner container 3 (i.e. inside inner container 3) and folded about wrapped group 2. In the FIG. 20-23 embodiments, on the other hand, coupon 18 is located between inner container 3 and outer container 4 (i.e. outside inner container 3) and folded about inner container 3.

In the FIG. 20-23 embodiments, top wall 22 is larger than extraction opening 9 of inner container 3, and so not only covers the whole of extraction opening 9, but also rests on part of top wall 6 of inner container 3. In a different embodiment not shown, top wall 22 is exactly the same size as extraction opening 9 of inner container 3, and so covers the whole of extraction opening 9, but no part of top wall 6 of inner container 3. In another embodiment not shown, top wall 22 is smaller than extraction opening 9 of inner container 3, and so covers none of top wall 6 and only part of extraction opening 9.

In one embodiment, fold line 21 and/or fold line 23 are tear lines (i.e. can be torn by exerting a small amount of pull) to detach lateral wall 20 and/or top wall 22 easily from lateral wall 19. In one embodiment, one, two or all three of walls 19, 20, 22 of coupon 18 may be glued to corresponding walls 7, 8*a* and 6 of inner container 3 using permanent glue (in which case, the joined parts must be torn apart irreversibly) or non-dry glue (enabling the joined parts to be re-glued repeatedly).

It is important to note that, in the FIG. 20-23 embodiments, lateral wall 19 of coupon 18 is sufficiently smaller than major lateral wall 7 of inner container 3 not to overlap and so impair operation of corresponding retaining tab 10.

The FIG. 20-23 embodiments have the main advantage of coupon 18 (or, rather, lateral wall 19 of coupon 18) possibly being larger than extraction opening 9 of inner container 3. Also, coupon 18 is kept separate from wrapped group 2, thus preventing the colouring agents in the printing on coupon 18 from affecting the aroma of the tobacco.

Packet 1 of cigarettes described has numerous advantages. In particular, it is easy to produce, even on a standard packing machine.

In packet 1 of cigarettes described, coupon 18 is concealed from view as long as the packet is sealed, while at the same time being removable quickly and easily when the packet is unsealed.

Given its many advantages, the design of packet 1 of cigarettes described may also be applied to the manufacture of cartons of cigarettes, which are substantially identical to packet 1 of cigarettes, except that they contain a group of packets of cigarettes, as opposed to a group of cigarettes.

Packing machine 31 described also has numerous advantages, by applying coupons 18 to wrapped groups 2 quickly, easily, and effectively. In particular, coupon 18 is held firmly in position in pocket 45 on third packing wheel 47, by having at least one wall—wall 20 or top wall 22—folded at an angle and so secured inside pocket 45 as to prevent coupon 18 from slipping randomly when folding blank 24 to form inner container 3. It is important to note that, being folded at an angle, coupon 18 can never be positioned on a slant (i.e. 'crookedly') with respect to wrapped group 2.

The invention claimed is:

1. A slide-open package of tobacco articles, comprising:

a parallelepiped-shaped rigid inner container (3) housing a wrapped group (2) of tobacco articles and having a bottom wall (5), an extraction opening (9) opposite the bottom wall (5), two parallel opposite major lateral walls (7), and two parallel minor lateral walls (8*a*, 8*b*) interposed between the major lateral walls (7);

a parallelepiped-shaped rigid outer container (4), which houses the inner container (3) to allow the inner container (3) to slide between a closed position, in which the inner container (3) is inserted inside the outer container (4), and an open position, in which the inner container (3) is at least partly extracted from the outer container (4); and a removable coupon (18), which is applied to the inner container (3), is folded about the group (2) of tobacco articles, and is located between the group (2) of tobacco articles and the inner container (3);

wherein the coupon (18) comprises: a first wall (19) which is positioned contacting a first wall (7) of the inner container (3); a second wall (22) which is connected to the first wall (19) along a first fold line (23), is folded 90° with respect to the first wall (19), and is superimposed on the extraction opening (9) of the inner container (3); and a third wall (20) which is connected to the first wall (19) of the coupon (18) along a second fold line (21), is folded 90° with respect to the first wall (19) of the coupon (18), is perpendicular to the second wall (22) of the coupon (18), and contacts a second wall (8*a*) of the inner container (3).

2. A package as claimed in claim 1, wherein the first wall (7) of the inner container (3) is a major lateral wall (7).

* * * * *